United States Patent [19]

Ehrlich et al.

[11] 4,052,013

[45] Oct. 4, 1977

[54] APPARATUS FOR SHREDDING RUBBER TIRES AND OTHER SCRAP MATERIALS

[75] Inventors: Stanley V. Ehrlich; John T. Ehrlich, both of Portland, Oreg.

[73] Assignee: Georgia-Pacific Corporation, Portland, Oreg.

[21] Appl. No.: 665,045

[22] Filed: Mar. 8, 1976

[51] Int. Cl.[2] ..... B02C 13/26

[52] U.S. Cl. ..... 241/101.2; 241/236; 51/249; 241/DIG. 31

[58] Field of Search ..... 241/74, 79.3, 80, 101.2, 241/223, 236; 198/DIG. 10; 214/8.5 C, DIG. 1, DIG. 4; 221/218, 253, 254, 312, 312 A; 51/249, 247

[56] References Cited

U.S. PATENT DOCUMENTS

| | | | |
|---|---|---|---|
| 2,726,047 | 12/1955 | Treshow | 241/178 |
| 2,853,246 | 9/1958 | Schoonover | 241/178 |
| 3,633,833 | 1/1972 | Ehrlich | 51/247 |
| 3,656,697 | 4/1972 | Nelson | 241/236 |
| 3,837,490 | 9/1974 | Driebel et al. | 241/178 |
| 3,931,935 | 1/1976 | Holman | 241/74 |

*Primary Examiner*—Granville Y. Custer, Jr.
*Attorney, Agent, or Firm*—Klarquist, Sparkman, Campbell, Leigh, Hall & Whinston

[57] ABSTRACT

Multiple cutting discs are fixed in spaced-apart positions on each of two side-by-side counterrotating shafts so that peripheral portions of the discs on each shaft extend into the spaces between discs on the opposite shaft. Each disc has a smooth cylindrical peripheral surface which meets opposed sidewalls at sharp continuous cutting edges. The clearance between adjacent discs on opposed shafts is small so that their cutting edges coact to shear material fed into the bight between opposed counterrotating discs in their feedthrough direction. Removable infeed teeth project from the peripheral surface of each disc at circumferentially spaced positions to help feed material into the bight between opposed discs. Material shredded by the discs falls onto a slowly rotating screening drum encircling the disc assembly. The smallest shredded pieces pass through such drum onto a discharge conveyor. Larger pieces are carried by the drum upwardly back to the infeed side of the cutting discs for reshredding into smaller pieces. A powered disc-sharpening grinder associated with the disc assembly simultaneously grinds the peripheral surfaces of all cutting discs on a shaft, after removal of their feed teeth. A lugged infeed conveyor feeds tires one at a time from a tire stack upwardly to the infeed side of the cutting disc assembly. The feeding of a tire into the disc assembly is alternated with the feeding of shredded material for reshredding so as not to overload the disc assembly.

3 Claims, 8 Drawing Figures

APPARATUS FOR SHREDDING RUBBER TIRES AND OTHER SCRAP MATERIALS

BACKGROUND OF THE INVENTION

1. Field of the Invention

The present invention relates to material shredders and particularly to a shredder for reducing rubber tires and similar bulk materials into small pieces.

2. Description of the Prior Art

The disposal of worn-out rubber tires is a major environmental problem. When reduced to particulate form, the tires can be more readily disposed of than otherwise by using the particles either as landfill, as a constituent of paving materials, or as a source of heat energy.

Prior shredders suitable for shredding rubber tires and similar bulk scrap materials have been of two general types.

One such type, exemplified by Ehrlich U.S. Pat. No. 3,561,308, employs a series of reciprocating or oscillating knives which coact with a stationary anvil to shear a tire moving across the anvil into diamond-shaped particles. This type of tire shredder, although effective, is too slow to be economical for most commercial high-production applications, requires a complex knife-driving mechanism, and has knives which are difficult and time consuming to resharpen.

The other general type of tire shredder is characterized by opposed counterrotating drums, with each drum defining a series of axially spaced-apart cutting discs. In most shredders of this type, as exemplified by Schwarz U.S. Pat. No. 3,880,361, the discs of one drum extend into the spaces between discs of the other drum and the discs have peripheral cutting teeth so that the overlapping discs interact to cut or tear tires into irregular pieces. The cutting teeth must be kept sharp to maintain the cutting effectiveness of the shredders. Additional shredders of this general type are shown, for example, in U.S. Pats. Nos. 3,664,592 and 3,845,907, as well as numerous patents showing similar types of apparatus in the crushing and grinding machine field.

In another counterrotating drum-type shredder, discs on one drum directly oppose discs on the opposite drum. One of each pair of opposed discs tapers to a single continuous knife edge at its outer periphery and abuts a blunt outer peripheral surface of the opposed disc. A shredder of this type is shown in Krigbaum U.S. Pat. No. 3,817,463. Material fed between the opposed discs is shred into long strips. In a modification of this concept, shown in Krigbaum U.S. Pat. No. 3,727,850, thin knife-edged discs spaced along one counterrotating drum extend into abutment with the blunt bottom surfaces of opposed grooves in the other drum to achieve a similar slicing action. In either case, it appears that a knife edge must be maintained on the cutting discs to achieve an effective cutting or slicing action. Such edge would rapidly dull in use through actual contact between the cutting elements of opposed drums, necessitating frequent resharpening and replacement of the cutting discs. Also, at least two sets of vertically stacked drums must be used, with the strips from the upper set being fed into the lower set for reshredding in order to reduce the strips to an acceptable small size.

Paper shredders have used the counterrotating drum-overlapping disc principle, as exemplified by Antonsen U.S. Pat. No. 1,939,246 and Goldhammer U.S. Pat. No. 3,630,460. The overlapping cylindrical discs of such paper shredders are typically relatively widely spaced apart so as to shred paper fed therebetween with a tearing rather than a shear-cutting action. Other paper shredders of this type have their overlapping discs in actual sliding frictional contact to cut the paper into strips, requiring considerable power to drive them. In either case, such paper shredders are typically small office machines and have not been thought applicable to the shredding of thick, tough, bulk elastic materials such as rubber tires.

From the foregoing it will be apparent that there is a need for a tire shredder capable of shredding tires into small particles at a high rate and having low and easy maintenance characteristics.

SUMMARY OF THE INVENTION

The present invention is an improved shredder of the counterrotating drum type especially suited for reducing rubber tires and similar bulk rubber and other scrap materials into small particles.

A primary object of the invention is to provide a shredder especially suited for shredding rubber tires into small particles at a rapid rate.

Another primary object is to provide a shredder as aforesaid of the counterrotating drum, overlapping disc type which requires no cutting teeth on the discs and therefore eliminates the tooth-sharpening problems of prior such shredders.

Another primary object is to provide a shredder as aforesaid with a simplified form of cutting disc which can operate for long periods of time, shredding rubber tires and other tough bulk materials without resharpening and which is easily resharpened when required.

Another primary object is to provide a shredder as aforesaid with self-sharpening means for resharpening the cutting discs quickly while they remain assembled on the shredder whenever such resharpening is required.

Another primary object is to provide a shredder as aforesaid which is adaptable to reduce rubber tires and other bulk scrap materials to particles of any desired size range.

A more specific object is to provide a shredder as aforesaid capable of recirculating shredded material through the cutting disc assembly until such material is reduced to a desired size.

Another important object is to provide a shredder as aforesaid with means for facilitating the infeed of material into the cutting disc assembly for shredding.

A significant feature of the invention, in conjunction with the aforementioned self-sharpening and infeed objects, is the provision of infeed teeth on the peripheries of the cutting discs which can be readily removed from the discs to enable the peripheries of such discs to be reground by the self-sharpening means.

The shredding apparatus of the invention is characterized by a pair of side-by-side parallel generally cylindrical and counterrotatable shredding drums. Each drum defines a series of axially spaced-apart cutting discs, each having a cylindrical peripheral surface intersecting opposed sidewalls so as to define a pair of substantially continuous cutting edges. Each drum is mounted with respect to the other drum so that the discs of each drum extend into the spaces between discs of the other drum, thereby overlapping or intermeshing. The clearance between adjacent cutting edges of overlapping discs is sufficiently small so that scrap materials fed into the bight between opposing drums in a feed-through direction are cut into pieces with a shear cutting action.

At least some of the discs of each opposing drum are provided with one or more infeed teeth which project outwardly from the cylindrical peripheral surfaces of the discs to help push scrap material into the bight between the opposing drums on their infeed side during their counterrotation. The feed teeth are insert teeth which are readily removable from their cutting discs so that the discs can be readily reground to resharpen their cutting edges while remaining in place on their respective drums, using a grinding wheel assembly forming part of the shredding apparatus. The feed teeth are not intended to provide any cutting action, and in fact are preferably spaced inwardly from the cutting edges of their associated discs.

A rotatable screening drum means encircles the shredding drum assembly and receives shredded pieces of scrap discharged from the shredding drums. The screening drum slowly rotates to lift scrap material too large to pass therethrough back to the infeed side of the shredding drums for reshredding into smaller pieces. This reshredding process is repeated until the shredded pieces can pass through the screening drum onto a discharge conveyor.

The foregoing objects, features and advantages of the invention will become more apparent from the following detailed description which proceeds with reference to the accompanying drawings.

DETAILED DESCRIPTION OF A PREFERRED EMBODIMENT

Shredding Drum Assembly

With reference to FIGS. 1–4 of the drawings, the shredding apparatus of the invention includes a pair of parallel, side-by-side counterrotatable shredding drums 10, 12 supported on a heavy structural steel frame including vertical frame members 14 extending upwardly from ground level and joined at their upper ends by cross frame members 16.

Figure 2:
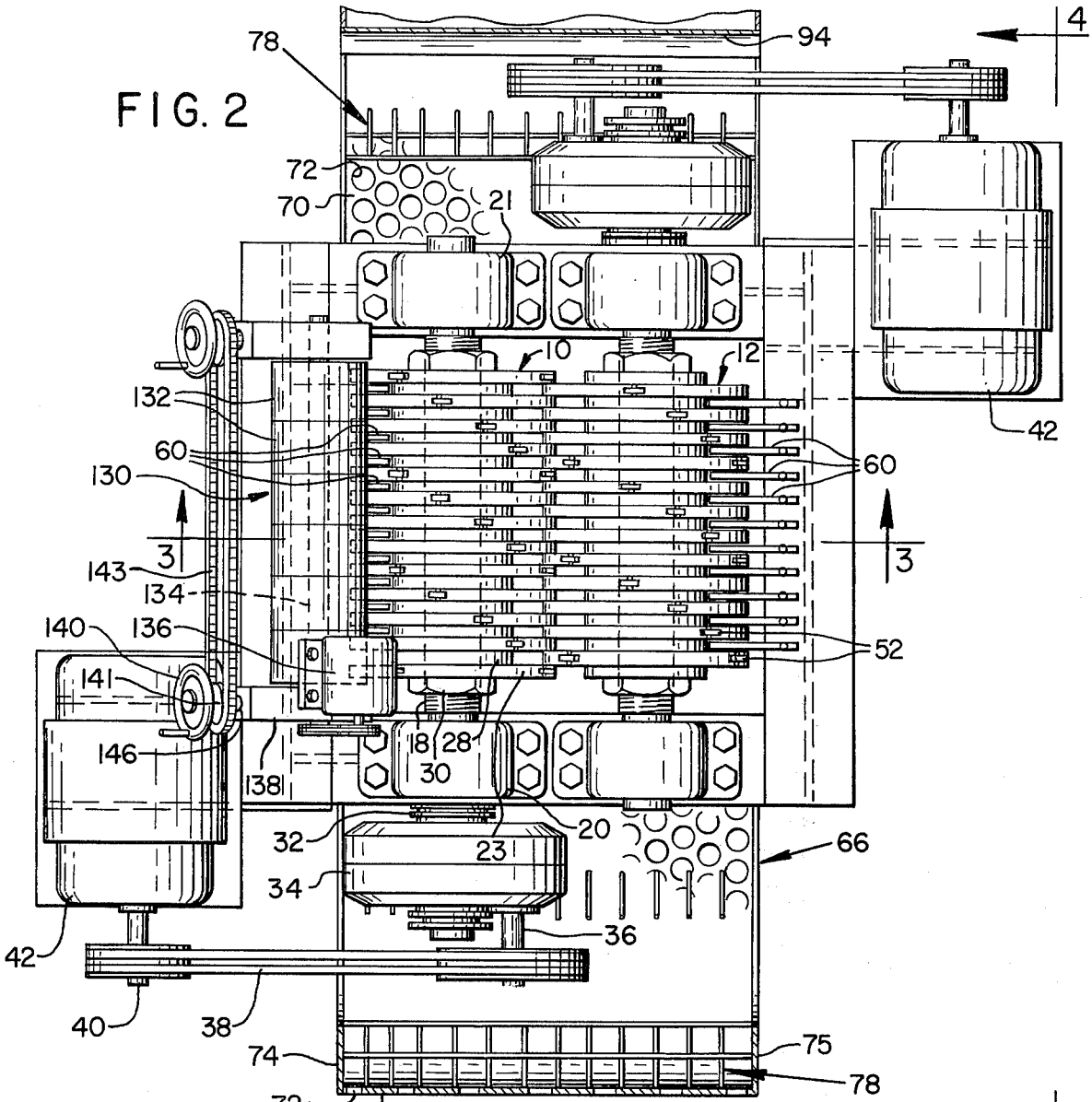
FIG. 2 is a horizontal sectional view taken approximately along the line 2—2 of FIG. 1 showing the shredding portion of the apparatus in plan.
Figure 3:
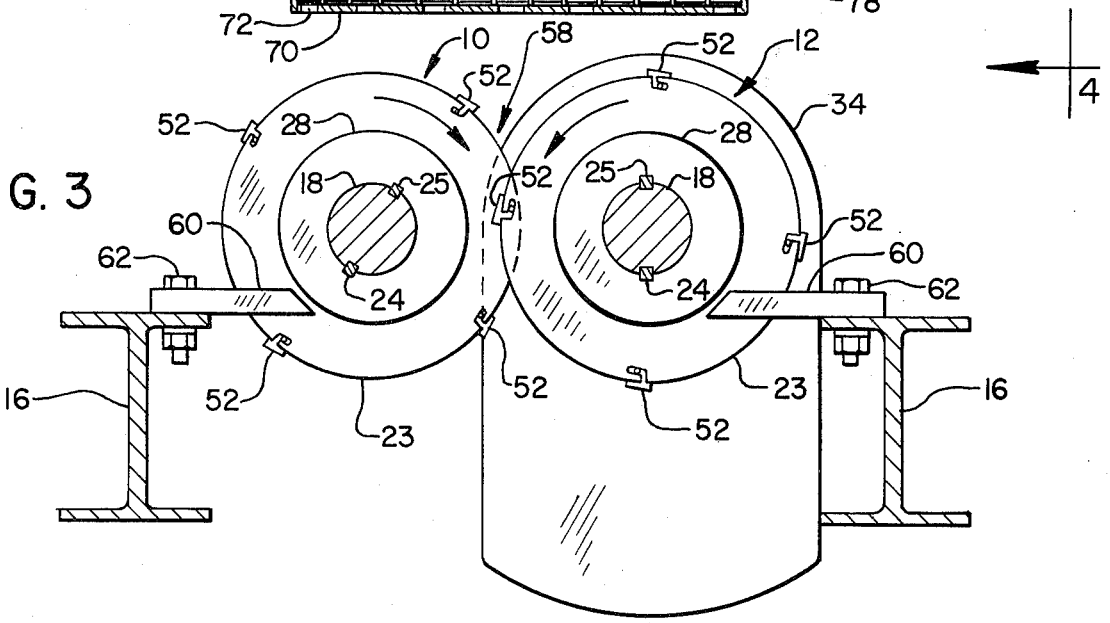
FIG. 3 is a vertical sectional view taken along the line 3—3 of FIG. 2 on an enlarged scale showing the shredding drum assembly of the apparatus.

As shown most clearly in FIGS. 2 and 3, each drum 10, 12 is composed of a central driven shaft 18 rotatably journaled at its opposite ends in bearing members 20, 21. A series of similar generally circular cylindrical cutting discs 23 are keyed to shaft 18 for rotation therewith by 180° opposed keys 24, 25. All cutting discs are of the same diameter and thickness. The cutting discs on each shaft 18 are equally spaced apart along such shaft by intermediate identical spacer discs 28 of considerably lesser diameter than cutting discs 23. The spacer discs are double-keyed to their respective shafts in the same manner as the cutting discs. The double-keyed mounting of the discs on the shafts prevents distortion of the shafts when they are subjected to high torsional loads. The discs on opposed shafts are arranged and the shafts themselves are mounted so that the cutting discs on one shaft extend partially into the gaps or spaces between cutting discs on the opposite shaft. Thus the opposed cutting discs intermesh or overlap. The spacer discs are of slightly greater thickness than the cutting discs, preferably of the order of about 0.010 thickness, so that there is a slight clearance between adjacent overlapping discs. The clearance is sufficiently small that the overlapping discs coact to cut rather than tear scrap material fed between such discs. The cutting discs and spacer discs are secured in position against axial movement on each shaft by nut members 30 threaded onto opposite end portions of each shaft.

Shredding Drum Drive

The drive means for counterrotating the shredding drums includes a separate but identical prime mover and drive train for each drum 10, 12. With reference to drum 10, its drive means includes an electric drive motor 42 carried on a motor support frame 43 extending from main frame 14. An output shaft 40 of motor 42 is connected by a belt-and-pulley drive 38 to the input shaft 36 of a torque-arm type of speed reducer 34. Speed reducer 34 has an output shaft coupled at 32 to driven shaft 18 of drum 10. The speed reducer is of a well-known type designed to disconnect its output shaft from the driven shaft when the output torque reaches a predetermined limit level.

Cutting Discs

Figure 5:
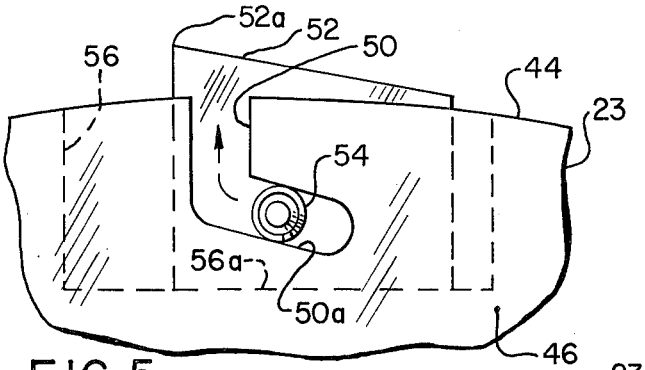
FIG. 5 is an enlarged partial side view of one of the cutting discs of FIG. 3, showing a feed tooth on such disc.
Figure 6:
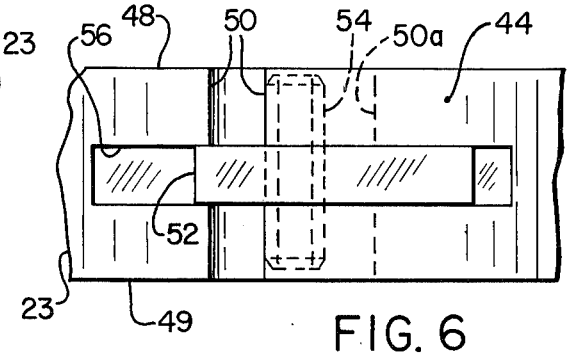
FIG. 6 is a top plan view of the cutting disc portion of FIG. 5.

Referring especially to FIGS. 3, 5 and 6, each circular cutting disc 23 has a smooth cylindrical peripheral surface 44 which meets opposed flat parallel sidewalls 46 at a pair of opposed cutting edges 48, 49. Thus the two cutting edges of each cutting disc are circular and continuous except for transverse slots 50 extending across the peripheral surface of the cutting disc at four equally circumferentially spaced positions about the disc, as shown in FIG. 3. In this sense cutting edges 48, 49 are substantially continuous.

Each transverse slot 50 intersects a narrow longitudinal recess 56 in the peripheral disc surface 44. The slot and recess cooperate to receive an insert tooth 52 and its associated retaining pin 54 which together comprise an infeed tooth means on the disc for helping force scrap material downwardly into the bight between opposed counterrotating drums in their feed-through direction of rotation. There are four such infeed teeth 52 on each cutting disc, although more or less could be used.

Each infeed tooth 52 is a generally wedge-shaped piece of tool steel having a uniform thickness dimension which is substantially less than the thickness of the cutting disc in which it is retained. Slot or recess 56 is centered between the opposite sides of the cutting disc so that the tooth 52 when inserted in the disc is spaced inwardly of cutting edges 48, 49, thereby performing no cutting function. Retaining pin 54 is a roll pin with a drill rod insert. The pin 54 is inserted through the body of tooth 52 so as to project from both sides of the tooth. Tooth and pin together are then inserted into their respective slots 52 and 50. Angular pin slot 50 has a lower leg 50*a* which extends at an inclination to the bottom surface 56*a* of tooth slot 56. Thus when infeed tooth 52 is inserted into slot 56 and forced rearwardly, pin 54 rides downwardly along leg 50*a* of slot 50, wedging tooth 52 against the bottom of slot 56. To remove tooth 52 from recess 56, the drill rod insert is tapped from pin 54 so that the pin can be pushed laterally from the tooth, after which the tooth is simply lifted from its recess. The length of pin 54 is slightly less than the thickness of disc 23 so that the ends of the pin do not protrude from the sides of the disc.

As shown in FIG. 2, the corresponding infeed teeth on all of the cutting discs of the same shaft are not axially aligned. Instead they are staggered or offset with respect to one another. In the illustrated embodiment the infeed teeth of axially adjacent discs are offset 30° from one another, always in the same direction, so that they assume a helical pattern over the entire drum. In practice this is accomplished simply by manufacturing identical discs 23 but with the keyways of each disc being offset progressively 30° in the same direction from the preceding adjacent disc. Then when the cutting discs are keyed on shaft 18, their teeth automatically are offset properly with respect to one another. Each infeed tooth 52 has a high end 52*a* which leads its lower opposite end in the direction of rotation of the drum on which it is mounted. Since the opposed drums counterrotate, the high ends of the teeth on opposed drums confront each other, that is, they rotate toward each other in the feed-through direction of rotation of the drums.

It is emphasized that the purpose of the infeed teeth is not to aid in the cutting or shredding of material, but rather to help force material fed to the infeed side of the drums, which is the upper side in FIG. 3, into the bight 58 between the drums in their downward or feed-through direction of rotation as viewed in FIG. 3. That the infeed teeth 52 have no cutting function will be clearly apparent from FIG. 6, showing one such tooth displaced laterally inwardly a substantial distance from cutting edges 48, 49 of its associated cutting disc 23.

A series of stripping fingers 60, shown in FIGS. 2 and 3, extend into the spaces between cutting discs of each drum and terminate near the outer peripheries of spacer discs 28 and near the sidewalls of the adjacent cutting discs. Such fingers strip shredded material wedged between cutting discs out from between such discs as they rotate, forcing it downwardly from the drum assembly. The stripping fingers are bolted at 62 near their outer ends to upper flange portions of cross frame members 16 of the shredder assembly.

Screening Drum

Encircling the entire shredding drum assembly in a substantially vertical plane is a screening means comprising a generally cylindrical rotatable screening drum 66. The slowly rotating screening drum receives shredded material discharged from the outfeed or underside of shredding drum assembly 10, 12 and passes the smaller shredded pieces through its foraminous outer wall 70 onto a discharge conveyor 68. Larger shredded pieces are carried upwardly and back to the upper infeed side of the shredding drum assembly to be reshredded into smaller pieces which will pass through the screening drum to discharge conveyor 68.

The foraminous outer cylindrical wall 70 of screening drum 66 has openings 72 of a size selected so as to pass material of the maximum particle size desired to be produced by the shredder. Opposite annular sidewalls 74, 75 extend radially inwardly from the outer foraminous wall 70 to form with the outer wall a sort of annular trough for containing shredded material which does not pass through the outer wall. The trough is subdivided circumferentially into equal trough sections indicated generally at 76 in FIG. 4 by a series of radially extending trough partitions 78. Trough partitions 78 are formed of an open grating structure and extend radially inwardly from outer wall 70 and terminate at their inner ends in alignment with trough sidewalls 74, 75. These grating partitions serve as carrier means to lift shredded strips of material upwardly to the infeed side of the shredding drum assembly for reshredding as the screening drum slowly rotates. At the same time such partitions permit smaller pieces of shredded material to sift downwardly through the partitions to the bottom of the screening drum and eventually through its outer wall to the discharge conveyor.

A retaining means is provided to prevent shredded materials from falling from the inwardly open trough sections as they move upwardly and generally vertically and then toward an upsidedown or dumping position directly over the shredding drum assembly. Such retaining means, shown most clearly in FIG. 4, includes a stationary curved shield wall 94 extending along and across a vertically extending and upwardly moving portion of screening drum 66 closely adjacent to the radially innermost open side of the trough. The shield wall is rigidly connected to an infeed hopper 98 and by such hopper and support members 96 to the main frame of the machine. Additional supports 97 also help support the infeed hopper structure 98 on such frame. The trough sections of the screening drum dump their loads into such hopper as they rotate toward upside-down positions. Two of the guide walls of such hopper are shown at 99, 100 in FIG. 4.

Figure 4:
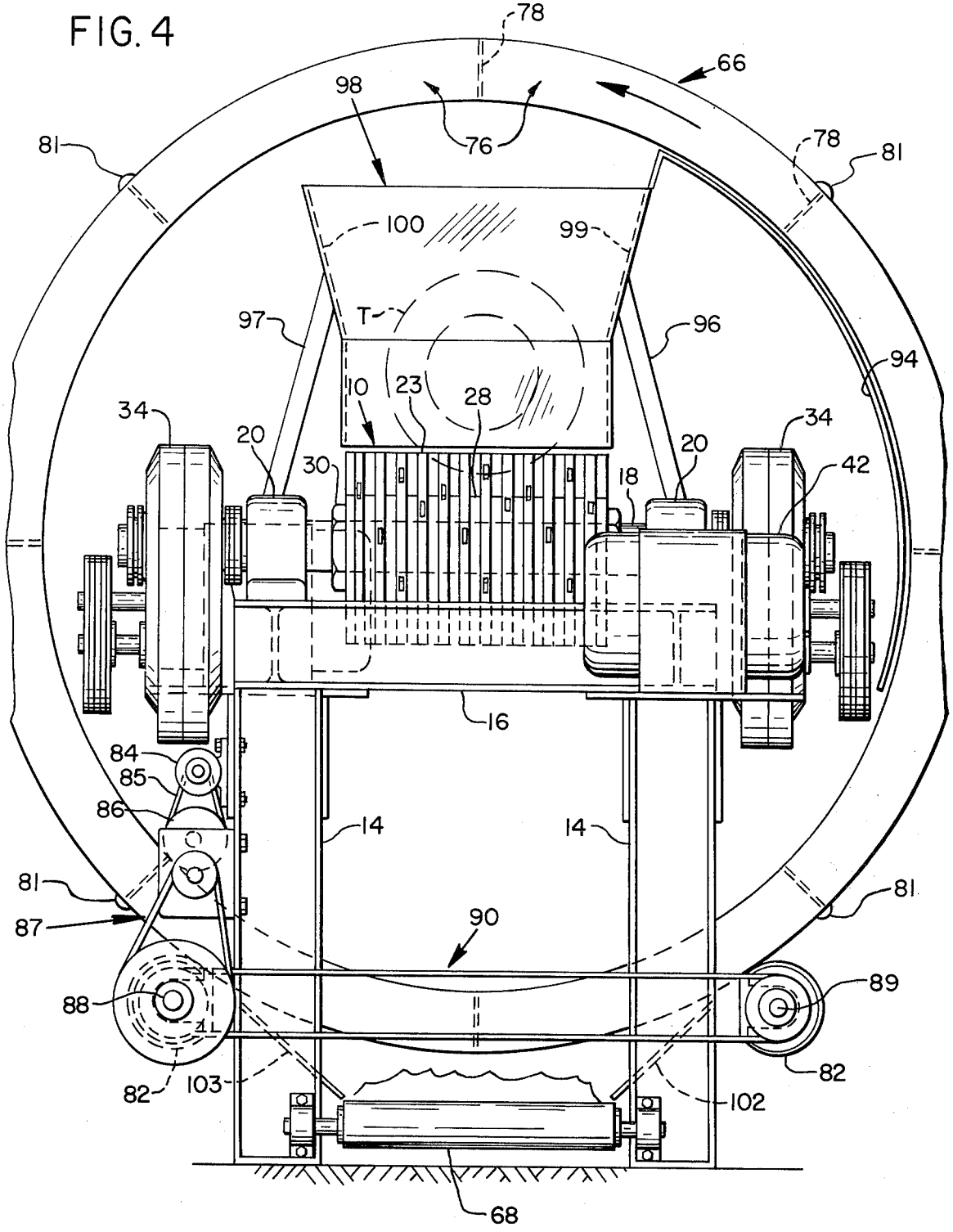
FIG. 4 is a side elevational view of the major portion of the apparatus.

Additional guide members, also shown in FIG. 4, define guide walls 102, 103 of a discharge chute for guiding shredded material passing through the screening drum onto the belt of discharge conveyor 68. Chute walls 102, 103 are affixed to upright frame members 14.

Screening Drum Drive

Figure 1:
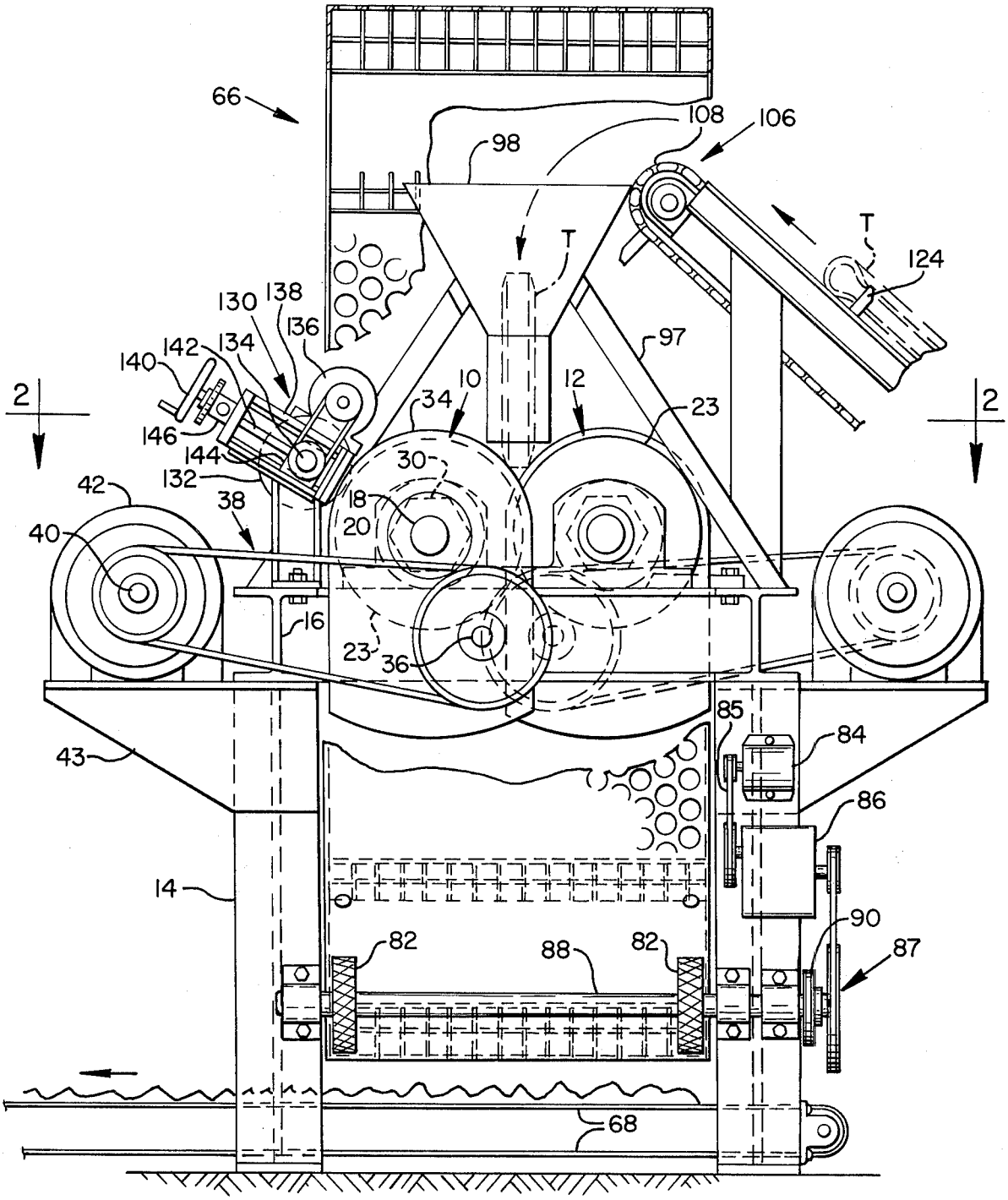
FIG. 1 is a front elevational view of the major shredding portion of a shredding apparatus in accordance with the invention.

Screening drum 66 is supported on opposed pairs of rubber pneumatic-tired wheels 82. The wheels are driven so as also to function as part of the drive means for rotating such drum. Referring to FIGS. 1 and 4, drive wheels 82 are driven by a variable speed drive motor 84. Such motor transmits power to the wheels through a belt-and-pulley drive 85, a speed reducer 86, a second belt-and-pulley drive 87 and an extension of a driven shaft 88 mounting the one pair of drive wheels 82. The second pair of drive wheels 82 on the opposite side of the lower end of the screening drum are fixed to a second shaft 89 (FIG. 4) driven through a belt-and-pulley drive 90 from the extension of shaft 88.

As the described drive means drives the wheels 82, they frictionally engage the undersurface of outer wall 70 of the screening drum to rotate such drum slowly in a counterclockwise direction as viewed in FIG. 4. Shake bumps 81 on the outside of wall 70 periodically pass over the wheels, shaking the screening drum to deposit a load into infeed hopper 98. Such bumps also help small particles to pass downwardly through the comb-like partitions 78 and through the outer wall of the drum itself.

Tire Infeed

Figure 7:
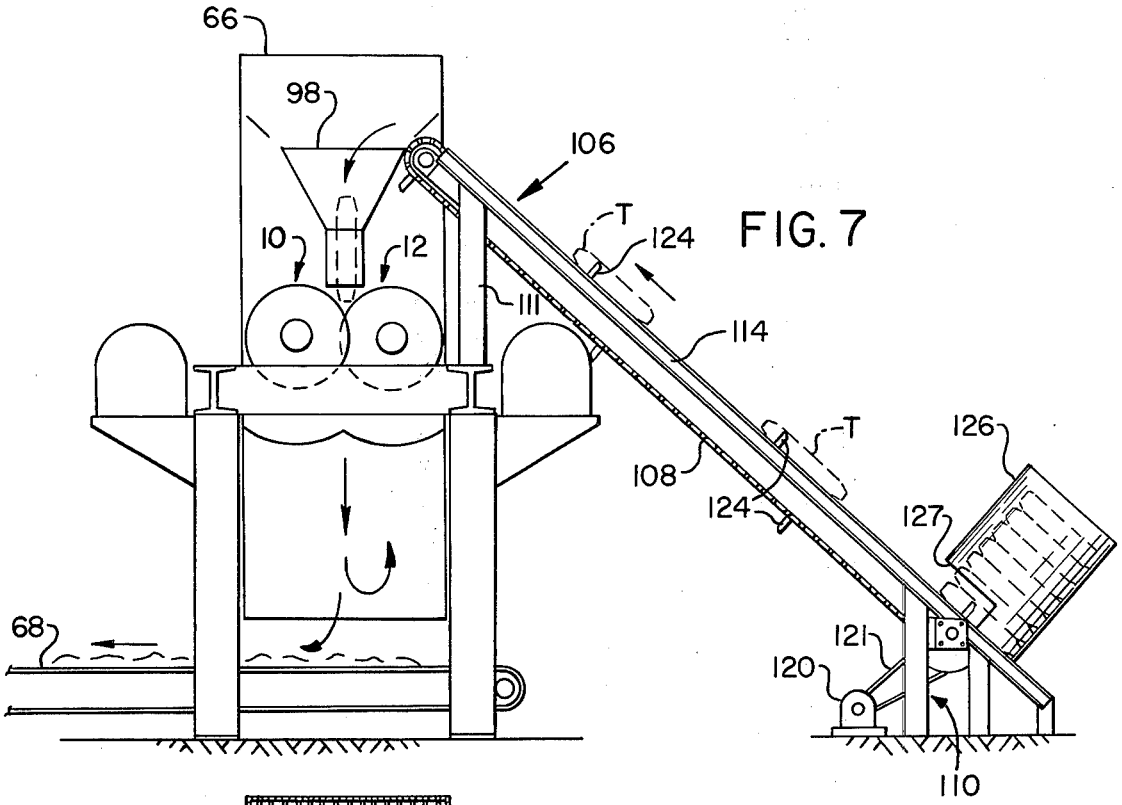
FIG. 7 is a somewhat schematic elevational view of the shredding apparatus including an infeed conveyor portion thereof.
Figure 8:
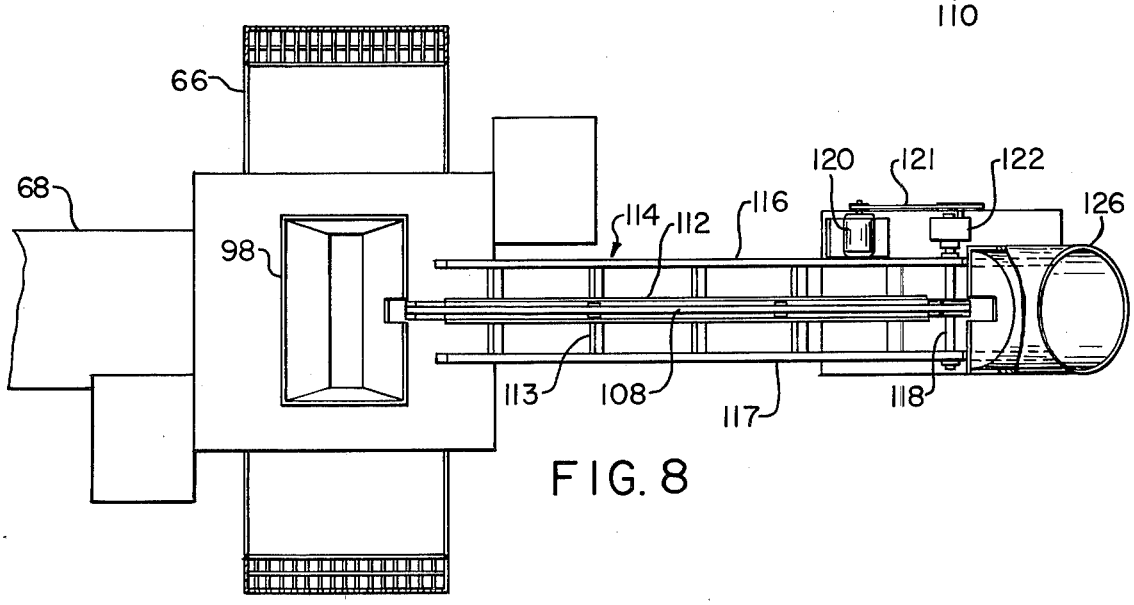
FIG. 8 is a somewhat schematic top plan view of the apparatus of FIG. 7.

Infeed conveyor means are also provided for delivering bulk rubber scrap into the infeed chute 98. Such infeed conveyor means, the upper end of which is shown generally at 106 in FIG. 1 and more completely in FIGS. 7 and 8, includes a lugged endless infeed conveyor chain 108 extending in an upward inclination from a lower infeed end near ground level to an upper outfeed end terminating adjacent to the upper end opening of infeed hopper 98. Infeed chain 108 has an upper run which travels along a center guideway 112 supported by cross frame members 113 of a conveyor support frame 114. Conveyor frame 114 has longitudinally extending opposite side rail members 116, 117 interconnected by cross frame members 113. The conveyor frame is supported at its lower end by ground level supports 110 and at its upper end by supports 111 connected to a main frame member 16 of the machine. The conveyor chain is trained about shaft-mounted sprockets at its opposite ends, the sprocket shafts being journaled in bearings carried by frame 114. The sprocket shaft 118 at the lower end of frame 114 is driven by a variable speed conveyor drive means including a drive motor 120, belt-and-pulley drive 121, and speed reducer 122, all as shown most clearly in FIG. 8.

Conveyor chain 108 has lugs 124 at equally spaced intervals along its length. A tire magazine 126 for containing a stack of tires T is mounted over the lower end of infeed conveyor frame 114 in a position such that each lug 124 enters the center opening of the lowermost tire T of the stack of tires in the magazine as it travels about the upwardly traveling lower end run of the conveyor chain. The magazine has a forwardly directed lower end opening 127. Thus each lug 124 drags the lowermost tire from the magazine forwardly onto the upper run of conveyor chain 108 and upwardly along side rails 116, 117, to the infeed hopper 98. At the upper end of the conveyor, the lug 124 flips its tire T vertically into hopper 98 as the lug travels about the downwardly traveling upper end run of the conveyor chain, thereby orienting the tire for proper guiding through the hopper into the bight between the shredding drums.

As previously indicated, both the drive means for screening drum 66 and the drive means for tire infeed conveyor 106 are variable speed drives. This enables desired coordination of the delivery of tires and shredded material for reshredding into the infeed hopper 98 so that the hopper and the shredding drums do not become overloaded. Preferably the delivery of shredded material and a tire to the infeed hopper is synchronized so that material for reshredding and tires are fed to the hopper alternately. More specifically, a trough section of the screening drum dumps its load, followed by the delivery of a single tire, then followed again by a load from the next trough section, in sequence.

Self-Sharpening Means

The shredding apparatus is also provided with a self-sharpening means for maintaining the cutting edges 48, 49 of the cutting discs 23 in cutting condition. The self-sharpening means, indicated generally at 130 in FIGS. 1 and 2, comprises a series of grinding wheel segments 132 fixed in side-by-side relationship on a driven shaft 134 adjacent to one of the shredding drums 10. A similar grinding wheel means is preferably mounted adjacent to the other drum 12, although not shown in FIGS. 1 and 2. Each grinding wheel assembly extends the full length of its associated drum so that all cutting discs on a drum can be ground simultaneously.

Grinding wheel shaft 134 is driven through a belt-and-pulley drive from an electric motor 136 mounted on a grinder support frame 138 at one end of the grinder assembly.

Grinder shaft 134 is mounted for in-and-out movement toward and away from the cylindrical peripheral surfaces of the cutting discs 23 on shredding drum 10 to move the grinding wheel segments into and out of contact with the drum. The means for effecting such in-and-out movement includes a hand wheel 140 which turns a screw shaft 142 threaded into a nut member 144. Nut member 144 is mounted for sliding movement along a slideway of frame 138 and carries one end of grinding wheel shaft 134. A similar nut member slidable in a similar frame carries the opposite end of shaft 134. Axial movement of screw shaft 142 is prevented by a mounting collar 146 on the screw shaft. Thus, when wheel 140 is turned, it rotates screw shaft 142, causing in-and-out movement of nut member 144 and its connected shaft 134 carrying the grinding wheel segments. A sprocket 141 is connected by a chain 143 to an identical screw shaft and nut type drive assembly at the other end of the grinding wheel so that the in-and-out motion induced at either end of the grinding wheel shaft 134 is also transmitted to the opposite end of such shaft for uniform and simultaneous movement of the entire shaft and grinding wheel assembly.

Although a manually operated feed for the grinding wheel is shown, in practice the grinding wheel could also be provided with an automatic feed, the details of which are shown and described, for example, in U.S. Pat. No. 3,633,833. Also as suggested in such prior patent, the grinder could be driven from one of the drive shafts or driven shafts for the shredding drums through an appropriate belt-and-pulley or chain-and-sprocket drive means.

The self-sharpening means as described is not used during the normal operation of the shredding drums to shred tires and other material, nor is it desirable to do so because of the presence of the infeed teeth 52 on the cutting discs of such drums. Instead, the self-sharpening means is only used when the cutting edges of the cutting discs require resharpening. In such instances the infeed teeth are first removed from the cutting discs before the peripheral surfaces of the cutting discs are ground.

It is most convenient to provide a separate grinding wheel assembly for each of the two shredding drums 10, 12. However, because it is expected that the cutting discs will only need to be reground infrequently, and because the grinding wheel assembly itself is self contained, it is possible if desired to provide only one grinding wheel assembly for the shredder. In such case, the grinder would be transferred from one side of the shredder frame to the other where it would be positioned alongside drums 12 to grind the cutting discs on such drum after grinding the cutting discs on drum 10.

Example

The following are dimensions and specifications for a typical stationary shredder as described suitable for shredding tires.

The clearance between overlapping cutting discs is important. Too much clearance causes the discs to tear rather than shear material, which in the case of tires could cause an overloading of the drive elements. Too little clearance causes frictional contact between the discs and therefore undue wear and high power requirements. For most tire-shredding applications, it is expected that the preferred clearance between adjacent overlapping cutting discs will be of the order of 0.004 to 0.006 inches.

A typical drum suitable for shredding tires has a shaft diameter of 5 9/16 inches, a cutting disc diameter of 24 inches, a cutting disc thickness of 1⅜ inches and an overall effective length of about 34⅜ inches. The overlap of opposed cutting discs is at least about ½ inch up to about 2 inches. The diameter of the spacer discs is about 14 inches. The thickness of the spacers is 1⅜ inches plus about 8 to 12 one-thousandths of an inch to give the desired clearance between adjacent overlapping cutting discs.

At a speed 22 revolutions per minute, it is estimated that the cutting discs will shred about 1,000 tires per hour, and with faster speeds up to 1,700 tires per hour. The typical screening drum has a 130 inch outside diameter and a 114 inch inside diameter at the inner circumference of the trough. It rotates at 1 to 2 revolutions per minute, giving it a rim speed of approximately 40 to 50 feet per minute. The openings in the screening drum are approximately 3 inches in diameter to produce particles in a a size range suitable for use as boiler fuel. The pneumatic-tired wheels which support and drive the screening drum typically have a 12 inch diameter.

A typical drive motor for each shredding drum is electrical and rated at 50 horsepower and 900 rpm. A suitable speed reducer for the drums is a Dodge torque arm double reduction speed reducer — Series TDT-1024 having a reduction ratio of 24.3:1. The drive means for the tire infeed conveyor is designed to move the conveyor chain at 83⅓ feet per minute or 1,000 lugs per hour at a typical 60 inch spacing between lugs. The speed reducer for the infeed conveyor could typically be a Dodge torque arm reducer — series TDT-315 having a 15:1 reduction ratio.

As for the self-sharpening means, the grinding wheel segments are typically 12 inches in diameter and 6 inches wide.

Each infeed tooth for the typical cutting discs described has an overall length of 1.875 inches, a maximum height of 1.25 inches, and a 10° slope from the leading end rearwardly along its top surface. The thickness of each tooth is 0.375 inches and the roll pin is ⅜ inch in diameter and 1.25 inches long.

Alternative Embodiments and Features

Rather than being stationarily mounted as shown, the shredder can be trailer-mounted and thereby made portable. In portable shredders, the primary drive would preferably be diesel-electric or diesel-hydraulic. A diesel engine mounted on the trailer would drive an electric generator or hydraulic pumps which in turn would drive electric or hydraulic motors to drive the shredding drums, screening drum, infeed conveyor and grinding wheels. A diesel fuel supply would also be carried on the trailer. The infeed conveyor would be constructed so as to fold for travel. The screening drum would also be capable of disassembly into half sections for travel.

Alternative forms of infeed tooth means other than insert teeth 52 may also be provided as feed means on the cutting discs. For example, insert teeth 52 could be replaced with other removable projections or lugs serving as infeed tooth means. Simple cap screws could serve this purpose. Tapped holes would be provided at intervals along the centerline of the peripheral surface of each cutting disc. Into each such tapped hole, a flat, Allen head cap screw would be threaded so that a substantial portion of the screw projected outwardly of the disc surface. Such screw-type lugs or teeth would be more readily insertable into and removable from the discs 23 than the teeth 52.

Operation

In normal operation of the shredder, grinding wheel 132 is withdrawn from engagement with cutting discs 23 of the associated shredding drum. The infeed teeth or lugs 52 are in place on the cutting discs.

Lugged infeed conveyor 106 conveys one tire T at a time upwardly from storage magazine 126 to infeed hopper 98, discharging such tire vertically into the hopper. The hopper guides the tire vertically downwardly into the bight 58 between the counterrotating drums 10, 12, which rotate inwardly and downwardly at the upper infeed side of such drums. Infeed teeth 52 force the tire down between the opposed coacting cutting discs 23 which shear the tire into strips which pass downwardly between the drums and drop onto slowly rotating screening drum 66.

The grating partitions 78 of the screening drum lift the rubber strips upwardly toward the infeed side of the shredding drum assembly. Fixed shield wall 94 retains the strips within the screening drum trough as they move vertically upwardly and then approach infeed hopper 98 on the infeed side of the shredding drum assembly. As a trough section of the screening drum containing the strips approaches a position over infeed hopper 98, the strips pass beyond shield wall 94, dropping from the screening drum into the infeed hopper, which guides such strips back into bight 58 between the shredding drums for reshredding by the cutting discs.

The reshred pieces, now much smaller than before, again pass downwardly through the shredding drums and drop back onto the foraminous outer wall of the screening drum. Those reshred pieces smaller than the openings of such screening wall pass through such wall and onto discharge conveyor 68 for removal to a storage site.

As the reshredding process continues, additional whole tires are carried one at a time upwardly on tire infeed conveyor 106 and discharged into the infeed hopper 98 for shredding. The deposit of each tire into hopper 98 is alternated with the dumping of a load of scraps for reshredding from the screening drum into such hopper.

When the cutting edges 48, 49 of cutting discs 23 are in need of resharpening, the infeed teeth or lugs 52 are first removed from the cutting discs. This is done simply and quickly first by removing roll pins 54 from their associated infeed teeth and then lifting the teeth from their recesses. Then with the drums counterrotating in their usual manner, the grinding wheels 132 are rotated and at the same time moved linearly toward the cutting discs by turning the hand wheel 140 until the desired grinding contact with the outer surfaces of the discs is made. It will be apparent that all cutting discs of drum 10 are ground simultaneously and to the same extent by the grinding wheel segments 132.

After the cutting discs are reground, the grinding wheel segements are withdrawn from the discs by turning hand wheel 140 in the appropriate direction. Then the roll pins are inserted back into their respective infeed teeth and the teeth reinserted into their appropriate slots and tapped downwardly and rearwardly therein until roll pins 54 wedge them securely in place. The shredding drums are now ready for shredding additional material.

Although the shredding apparatus has been described with reference to the shredding of rubber tires and the reshredding of tire strips, it will be apparent that the apparatus generally as described would also be appropriate for shredding other bulk scrap rubber and other scrap materials in a highly efficient manner. Also by changing the size of the screening drum openings, the size range of particles produced by the shredding apparatus can be controlled and varied.

Having illustrated and described the principles of our invention with reference to a presently preferred embodiment and several possible alternatives, it should be apparent to those skilled in the art that the invention may be modified in arrangement and detail without departing from such principles. We claim as our invention all such modifications, whether specifically disclosed or not, as come within the true spirit and scope of the following claims.

We claim:

1. A shredding apparatus comprising:

a pair of side-by-side parallel and generally cylindrical shredding drums, each said drum defining a series of axially spaced-apart circular cutting discs, each said cutting disc having a smooth cylindrical peripheral surface intersecting parallel opposed sidewalls so as to define a pair of substantially continuous circular cutting edges, each said drum being mounted with respect to the other said drum such that discs of one drum extend into the spaces between discs of the opposing drum, drive means for counterrotating said drums, said rotatable grinding wheel means positionable alongside said drums with the axis of rotation thereof parallel to the axes of rotation of said drums and extending the length of the adjacent said drum when in an operating position, said grinding wheel means including drive means for rotating said grinding wheel means about its axis of rotation and means for moving said grinding wheel means into and out of grinding engagement with the cylindrical surfaces of the cutting discs of an adjacent said drum.

2. Apparatus according to claim 1 wherein said cutting discs include infeed tooth means circumferentially spaced apart on the cylindrical surfaces of said cutting discs, said infeed tooth means including means removably mounting them on said discs to enable sharpening of said cutting edges by said grinding wheel means after removal of said tooth means from said discs.

3. Apparatus according to claim 1 wherein said grinding wheel means includes a cylindrical grinding wheel comprising a series of side-by-side cylindrical grinding wheel segments mounted for rotation on a common driven shaft.

* * * * *